United States Patent [19]

Klier et al.

[11] Patent Number: 4,961,461

[45] Date of Patent: Oct. 9, 1990

[54] METHOD AND APPARATUS FOR CONTINUOUS CASTING OF COMPOSITES

[75] Inventors: Eric Klier, Irving, Tex.; Andreas Mortensen, Cambridge, Mass.; James A. Cornie, North Chelmsford, Mass.; Merton C. Flemings, Cambridge, Mass.

[73] Assignee: Massachusetts Institute of Technology, Cambridge

[21] Appl. No.: 207,573

[22] Filed: Jun. 16, 1988

[51] Int. Cl.[5] ..... B22D 11/00

[52] U.S. Cl. ..... 164/461; 164/97; 164/900

[58] Field of Search ..... 164/97, 461, 900

[56] References Cited

U.S. PATENT DOCUMENTS

| | | | |
|---|---|---|---|
| 3,858,640 | 1/1975 | Sifferlen | 164/97 |
| 4,469,757 | 9/1984 | Ghosh et al. | 428/614 |
| 4,617,979 | 10/1986 | Suzuki et al. | 164/97 |
| 4,657,065 | 4/1987 | Wada et al. | 164/461 |
| 4,662,429 | 5/1987 | Wada et al. | 164/461 |
| 4,702,770 | 10/1987 | Pyzik et al. | 75/236 |
| 4,713,111 | 12/1987 | Cameron et al. | 75/68 R |
| 4,718,941 | 1/1988 | Halverson et al. | 75/236 |
| 4,759,995 | 7/1988 | Skibo et al. | 428/614 |
| 4,786,467 | 11/1988 | Skibo et al. | 420/129 |

FOREIGN PATENT DOCUMENTS 0256600 2/1988 European Pat. Off. .

OTHER PUBLICATIONS

Pai et al. "Production of Cast Aluminum-Graphite Particle Composites using a Pellet Method," *Journal of Materials Science*, 13 (1978) 329-335.

Abdul-Lattef et al., Preparation of Al-$Al_2O_3$-MgO cast particulate composites using MgO coating technique, Journal of Matrials Science Letters 4: 385-388 (1985).

Barry A. Mikucki et al., Magnesium Matrix Composites at Dow: Status Update, Light Metal Age, Oct. 1986.

*Primary Examiner*—Richard K. Seidel

*Attorney, Agent, or Firm*—Fish and Richardson

[57] ABSTRACT

The continuous manufacture of a composite in which dispersates are mixed within a matrix material is set forth. Molten metal alloy and concentrated dispersion containing a particulate ceramic dispersate in a precurser dispersion material are continuously fed into a chamber where the mixture is first blended, then agitated to shear both the particulate and matrix. Well dispersed slurry is then fed into a crucible for solidification processing, or is continuously cast into a billet.

10 Claims, 2 Drawing Sheets

METHOD AND APPARATUS FOR CONTINUOUS CASTING OF COMPOSITES

Rights of the United States Government

Part of the work described in this application was performed under the terms of Contracts #NAG-3-808and N00014-85-K-0645 between the U.S. Government and the Massachusetts Institute of Technology. The United States accordingly has certain rights to use of the technology described herein.

TECHNICAL FIELD

This invention relates to solid composite materials including a continuous matrix material and a plurality of separate particles, called dispersates, of one or more materials distinct from the matrix, dispersed through the matrix, and to methods for making such composites. The invention is particularly related to composites in which the dispersates are substantially uniformly distributed throughout the volume of the composite, and is more particularly related to composites in which the matrix is a metal or alloy and the dispersates are ceramic, and to the reduction of porosity that normally accompanies the introduction of ceramic particulate reinforcement into molten alloys or alloys in the semi-solid state.

TECHNICAL BACKGROUND

Composite materials often have better mechanical properties than either the matrix or the dispersates alone. The desirable properties are generally maximized when the dispersates are distributed as uniformly as possible within the matrix, but making composites with such uniform dispersions has often proved difficult.

One method for making composites is to disperse the dispersates in a precursor liquid and then form the composite by solidifying the liquid part (or "dispersion medium") of the dispersion. A significant practical difficulty with this simple method is that any difference in density between the dispersates and the dispersion medium may cause a generally undesired segregation of the dispersates toward either the top or bottom of the dispersion and thus of the final composite.

U.S. Pat. No. 4,735,656 of Apr. 5, 1988 to Schaefer et al. teaches a method of avoiding segregation due to density differences by mixing metal particulates with ceramic particulates, heating the mixture to a temperature sufficient to cause partial melting of the metal so that it fuses into a dense matrix when cooled, but insufficient to cause the ceramic particulates to float in the metal matrix.

Another frequent problem with simple mixing is that some of the most desirable composites are made from dispersates that are difficult to wet by any known fluid precursor of the desired matrix phase. International Patent Application WO 87/06624, published Nov. 5, 1987, teaches a method of ameliorating the difficulties when using dispersates that are difficult to wet, by using specific types of dispersing and/or sweeping impellers that promote high shear mixing while minimizing the introduction of gas into the mixture and the retention of gas at the interface between the dispersates and the dispersion medium. U.S. Pat. No. 4,662,429 of May 5, 1987 to Wada et al. teaches use of lithium in a melt of aluminum matrix alloy to facilitate wetting of the reinforcing material and ready dispersal thereof in the matrix alloy. European Patent Application No. 87 201

512.8 published Feb. 24, 1988 describes composites of a zinc-aluminum alloy reinforced with silicon carbide powder which has good mechanical properties without the difficulties often experienced with other similar composites.

Difficulties in making good quality composites, and various expedients tried to overcome those difficulties are generally reviewed by P. K. Rohatgi et al. in "Solidification, structures, and properties of cast metal-ceramic particle composites", 31 *International Metals Reviews* 115-39 (1986). One method from Rohatgi is described in more detail by B. C. Pai et al., 13 *Journal of Materials Science* 329-35 (1978). This method involves pressing together dispersates with powdered matrix material to form a pellet, introducing this pellet beneath the surface of a quantity of fluid matrix precursor material for long enough to melt the pellet matrix, stirring to disperse the dispersates within the total amount of fluid precursor material, and then solidifying the dispersion. Analogously, J. Cisse et al. in 6B *Metallurgical Transactions* 195-97 (1975) describe use of a "master alloy" of rods made from sintered aluminum powder and containing 10% of aluminum oxide.

All the prior art methods known to applicants initially produce composites with substantial porosity unless the dispersates are quite easily wet by the fluid matrix material, and in the latter case, the properties of the composite are often degraded by chemical reaction between the matrix and the dispersates. It is therefore an object of this invention to produce composites as free as possible from porosity and to minimize the time required to make the composite, so that chemical degradation of the interfaces in the composite is minimized.

SUMMARY OF THE INVENTION

The properties of composites that are most desirable for many purposes are achieved when the dispersates are sufficiently widely dispersed that most of them do not touch another dispersate particle. This type of composite is characterized herein as having "discrete" dispersates or as a "discrete" dispersion. It has been found in accordance with this invention that many of the difficulties of the prior art in making composites with discrete dispersates can be overcome by using an indirect method. This involves first making a concentrated dispersion in which there is intimate contact between a precursor of the final matrix desired (dispersion medium) and the dispersates. Preferably the concentrated dispersion has no more than five volume percent of voids and/or gases. Still more preferably, porosity is substantially entirely eliminated from the concentrated composite. If a packed dispersion bed is evacuated prior to infiltration, porosity is substantially eliminated in the concentrated dispersion. This eliminates this source of porosity in the final diluted composites. Dispersions with these characteristics can be more readily made with higher concentrations of dispersates than as is usually most preferred in the final product.

The concentrated dispersion is used for the formation of a more dilute dispersion by mixing it with additional fluid precursor of the matrix of the finally desired composite. If this mixing is done while the dispersion medium of the concentrated dispersion is still fluid, then the particular embodiment of the invention is described as a "continuous" method. Sometimes, it is more convenient to solidify the dispersion medium of the concentrated dispersion, producing what is called herein a "concentrated composite" before beginning the mixing step that leads to the finally desired composite. Composites made in this way are denoted as made by the "concentrated composite" embodiment of the invention.

It has been found that a satisfactory concentrated dispersion according to this invention can be made by packing dispersates to form a porous bed, in which most dispersates are touching at least one other dispersate, then infiltrating the packed bed with a fluid precursor of the desired final matrix in such a way that (i) the reasonably uniform distribution of dispersates characteristic of the packed bed is maintained during the infiltration and (ii) most if not all of the gas existing in the interparticle volume of the bed is displaced during the infiltration. In this way, the infiltrated part of the packed bed of dispersates is converted into a concentrated dispersion suitable for use in this invention.

If the porous bed of dispersates is evacuated, infiltration of fluid into the bed may be accomplished from all directions if convenient, eliminating the need for unidirectional infiltration. Often, however, it is more convenient to avoid any need for evacuation by infiltrating the porous bed from one direction only, allowing displaced gas to escape through a part of the bed that remains open as infiltration proceeds. Even when the fluid precursor used does not spontaneously wet the dispersates, infiltration of the bed may be achieved with the application of pressure to the fluid. The process of infiltration may, and in fact preferably does, separate some of the interparticle contacts between dispersates, but the dispersion produced by infiltration will still be more concentrated than the final desired dispersion.

The mixing of the concentrated dispersion with additional precursor fluid (which may be the same or different from the precursor fluid used to make the concentrated dispersion) should normally be accomplished in a way that avoids the difficulties encountered when attempting to disperse small particles directly in an open container of fluid. It has been found that concentrated dispersions made by the methods described herein often have the very favorable property that, at some temperatures, they behave as if the dispersates are so well bonded to the matrix that each dispersate tends to carry a substantial amount of matrix material along with it when moved. With these favorable concentrated dispersions according to the invention, mixing is very easy. Portions of the concentrated dispersion can simply be placed on top of a second matrix fluid, if the dispersates are denser than the matrix, or covered with a second matrix fluid, if the dispersates are less dense than the matrix. A combination of the influences of gravity and stirring then serves to mix the dispersates into the total amount of fluid precursor for the final matrix.

This invention can still be used even with concentrated dispersions that do not have such favorable properties as described above. For the continuous process, it is often convenient to provide a pressurizable reservoir of concentrated dispersion from which the dispersion can be injected into a quantity of the second precursor fluid. It is generally preferred to inject the concentrated dispersion into a flowing stream of the second precursor fluid, in order to aid mixing. For the concentrated composite method, a portion of the concentrated composite can be held mechanically below the surface of a body of second precursor fluid, maintained at a temperature high enough to reliquefy at least part of the matrix of the concentrated composite, and portions of the two components of the concentrated composite can be mixed into the second precursor fluid as the liquefaction occurs. Alternatively, the concentrated composite can be heated to and held at a temperature sufficient for partial liquefaction of its matrix, and additional fluid precursor added with mixing.

High shear rate mixing is often preferred to disperse small clusters or agglomerates of dispersates remaining from the concentrated dispersion. High shear mixing is also useful to provide a uniform distribution in the final desired diluted composite. During mixing, the temperature should normally be maintained, if possible for the particular dispersates and matrix used, within a range where the mixtures containing the dispersates exhibit thixotropy. In this way, efficient mixing in the immediate vicinity of the mixing zone can be achieved without as much danger of resegregation of the dispersates, due to density differences, as the mixed material moves away from the mixing zone.

In connection with this description of the invention, it should be understood that a precursor of a matrix material is any other material that can be converted to the matrix material by chemical or physical treatment without dislocating any dispersates contained therein. For example, liquid alloy or thermoplastic is a precursor of the solid alloy or thermoplastic into which it hardens on cooling; fluid mixtures of polyfunctional isocyanates and polyfunctional alcohols are precursors of the polyurethanes that they can form by chemical reaction after mixing; and fluid acrylated materials are precursors of the polymer that they can form after being exposed to the action of an electron beam. Also, the term "matrix" includes the continuous phase of any dispersion or composite, whether in a fluid or a solid state.

One aspect of the invention is the final composites produced. It is believed that this invention provides the first cast discrete dispersions that are substantially free of pores and have substantially uniform dispersion of the dispersates, as illustrated by some of the drawing figures herein. In particular, it is believed that dispersions containing not more than 40 volume percent of dispersates and not more than 5 volume percent of voids, pores, and/or gases are new.

DESCRIPTION OF THE PREFERRED EMBODIMENTS

Figure 1:
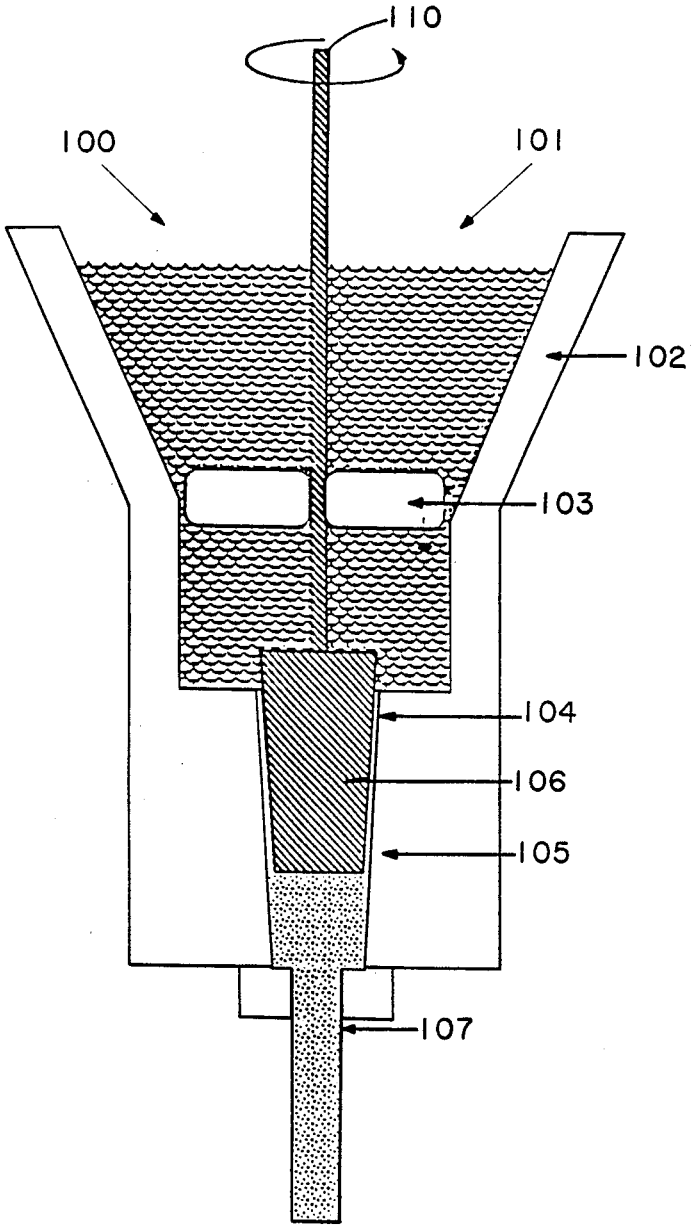
FIG. 1 is a cross-sectional view of an apparatus to continuously produce a metal matrix composite.

Some of the most useful applications of this invention are the manufacture of composites of silicon carbide dispersed in aluminum or magnesium alloys. Such materials are valuable materials of construction for applications such as aircraft where a combination of low density, toughness, and flexural resistance at temperatures not too far below the melting point of the alloy are needed In the past, it has been very difficult to make these composites with about 20 weight % silicon carbide, the most mechanically useful range, with the substantially uniform dispersion of silicon carbide particles that is needed, particularly when the silicon carbide particles are mostly less than ten microns in size and/or have a wide distribution of sizes. Such composites can readily be made by the present invention.

In order to promote displacement of the atmosphere in the interparticle pores at lower pressures, thereby reducing the cost of infiltration processing, during the formation of composites of silicon carbide and aluminum alloy according to this invention, materials, such as tin and potassium hexafluorozirconate, that promote the wetting of silicon carbide can advantageously be added to the aluminum alloy used as the fluid material for forming the concentrated dispersion.

Alloys of aluminum containing from about 1 to 4% silicon have been found in the prior art to make stronger composites when reinforced with silicon carbide than do aluminum alloys with less silicon, even though low silicon alloys are stronger when unreinforced than the alloys containing as much as 1 % silicon. The difficulty of making composites with low-silicon aluminum alloys is believed to be due to reaction between the low-silicon aluminum and the surface of silicon carbide dispersates to form aluminum carbides. This weakens the silicon carbide particles and makes them less effective reinforcement.

The difficulties with low silicon aluminum can readily be overcome with the present invention by coating the silicon carbide dispersate particles with some material that inhibits the reaction with aluminum. Silicon dioxide, which can be formed on silicon carbide by heating it in air, is particularly convenient. Heating silicon carbide powder at 1300 C. for 30 minutes, for example, results in particles that disperse much more easily in and form a more uniform composite with low silicon aluminum alloys. Alumina, which can conveniently be coated onto silicon carbide particles from a seeded sol, also forms a useful barrier against reaction to form aluminum carbides. Such coatings are generally not needed for final composites with magnesium based alloys, because the formation of carbides is not as extensive, even if the magnesium is alloyed with aluminum.

The practice of the invention can be further appreciated from the following non-limiting examples. In particular, the continuous manufacture of a composite in which dispersates are mixed within a matrix material may be achieved in a variety of ways, two of which, relating to metal alloy matrix materials and particulate ceramic dispersates will be described more completely below.

EXAMPLE 1

Referring to FIG. 1, molten metal alloy 100 and concentrated dispersion 101 containing a particulate ceramic dispersate in a precursor dispersion material are continuously fed into chamber 102. The partly liquid mixture is pumped and blended by rotor 103 into region 104, where it is vigorously agitated. As the alloy 100 and the concentrated dispersion 101 are agitated in region 104, they are mixed by the high shear provided by the narrow gap between wall 105 and conical rotor 106. Moving rod 110 and conical rotor 106 up and down in chamber 102 allows control of gap 104. Rod 110 rotates at between 100–900 revolutions per minute. Well dispersed slurry 107, comprising the now diluted metal matrix composite can be fed into a crucible (not shown) for solidification processing, or may be continuously cast into a billet.

In another embodiment, a previously solidified concentrated composite could be rotated at high rates within the molten metal so that the concentrated composite is "peeled off" by shearing at the composite/liquid metal interface. The high shearing rate thus provided would assure good dispersion of the dispersate phase into the finally produced composite.

EXAMPLE 2

Figure 2:
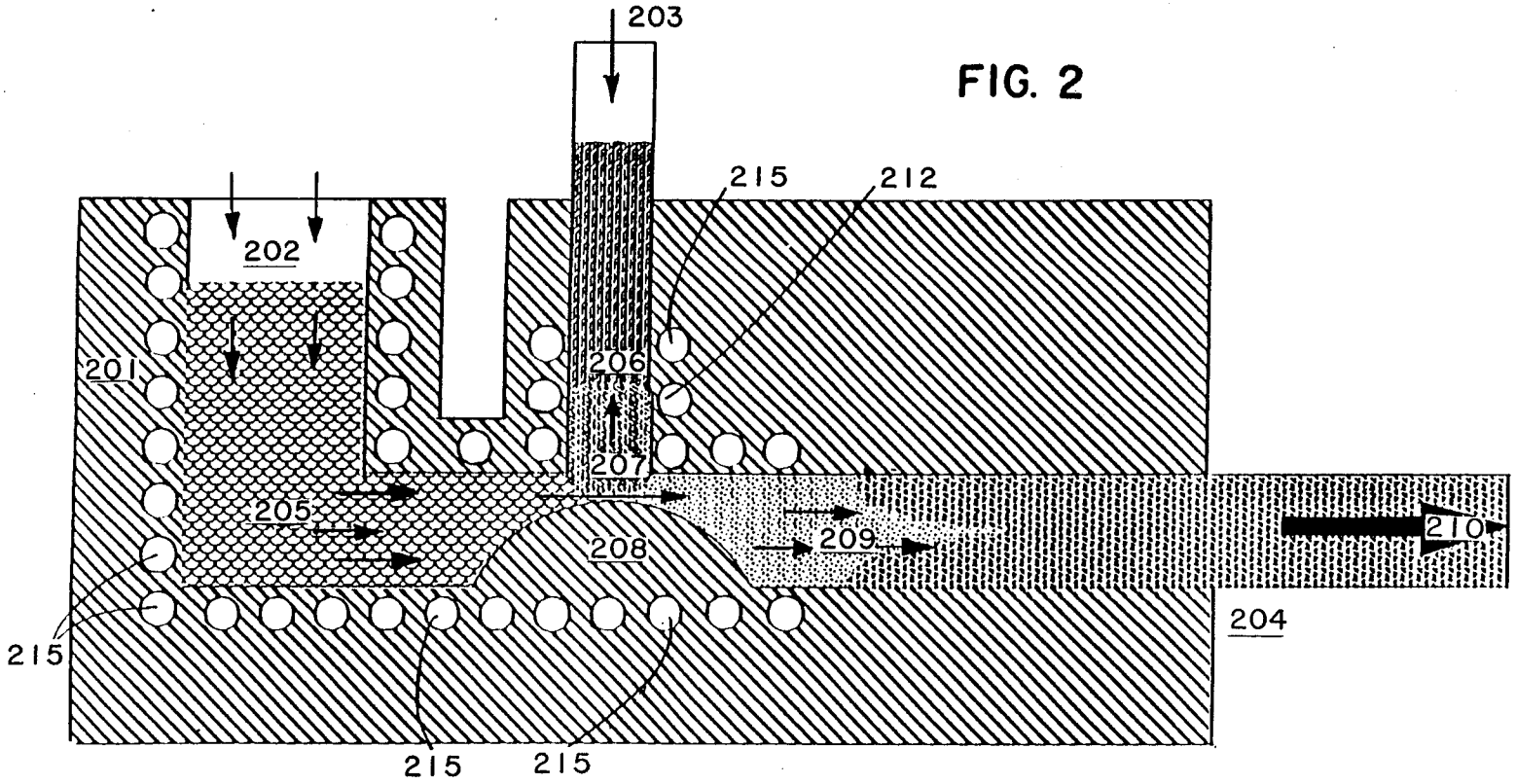
FIG. 2 is a cross-sectional view of another apparatus adapted for the continuous production of a metal matrix composite.

FIG. 2 illustrates another apparatus for the production of a metal matrix composite that both infiltrates a dispersate with a fluid percursor and disperses the resulting concentrated dispersion in rapid succession and in a continuous manner. This embodiment may utilize the pressure necessary for the infiltration of the dispersate by the liquid precursor to provide the driving force for the shear deformation required to disperse the dispersates.

Referring to FIG. 2, chamber 201 contains liquid metal entrance 202 and dispersate entrance 203. At entrance 202, molten metal 205 is supplied under pressure. At dispersate entrance 203, dispersate 206 is supplied under pressure by a ram, screw-feeding device, or any other appropriate device (not shown).

Chamber 201 uses chambers 215 to heat or cool the passages through which the dispersates and metal flow. Accordingly, chamber 201 is heated at entrance 202 to keep molten metal 205 in its liquid state, but is cooled at entrance 203 and at exit 204 where the composite exits the apparatus. This variation creates a strong temperature gradient within the channels through which the dispersates and metal flow. The pressure differential between molten metal 205 and dispersates 206 causes the liquid metal to penetrate and infiltrate the dispersates in region 207. The temperature gradient cools the metal as it infiltrates the dispersates until it begins to solidify and choke in region 207. In this manner, concentrated dispersion 212 is created in a continuous manner.

Where molten metal 205 contacts concentrated dispersion 212, flow and shear of the metal is accelerated by any appropriate means. FIG. 2 shows one acceleration means comprising a constriction 208 configured with a geometry such that the concentrated dispersion 212 is continuously entrained downstream (indicated by arrows), shearing and dispersing into the flowing metal. Other embodiments of this acceleration means could include a mechanical or electromagnetic stirring device. At some point 209 downstream from the acceleration area, the composite, a homogeneous and essentially pore-free slurry 210 may be continuously cast through exit 204 to yield a solid billet of the composite having any desired cross-section.

The speed of the casting of composite 210 and the volume fraction of the reinforcement material present in composite 210 may be regulated by varying the relative feeding rates of reinforcement material 206 and metal 205 at entrance regions 203 and 202.

Exit 204 need not be maintained at a temperature cool enough to solidify the composite. Instead, a semi-liquid slurry could be ejected from exit 204 for further processing. As well, the composite 107 depicted in FIG. 1 could also be further processed after exiting the vessel.

In other embodiments, the composite flow exiting the continuous process apparatus could be interrupted or stored in a liquid or semi-liquid state for a period of time. For example, the apparatus depicted in FIG. 1 or FIG. 2 could be suitably modified for use in a die-casting process.

The invention disclosed herein is not limited to the specific examples described. Various other embodiments can be used according to this novel process to continuously cast composites.

What is claimed is:

1. The process for the continuous manufacture of a composite of a plurality of discrete and substantially uniformly dispersed solid dispersates within a matrix material comprising:

introducing a fluid precursor of the matrix material and dispersates under pressure into a vessel through matrix and dispersate material entrance regions;

initially infiltrating the dispersate material with the fluid matrix material to provide a concentrated dispersion having no more than five volume percent porosity;

dispersing the concentrated dispersion into the fluid matrix material by highly shearing the matrix material and the concentrated dispersion to provide the composite; and casting the composite through a composite exit region of the vessel.

2. The process of claim 1 wherein the pressure is provided by mechanical action or pressurized gas.

3. The process of claim 2 wherein the mechanical action is provided by a ram or a screw.

4. The process of claim 2 wherein the mechanical action or pressurized gas provides the shearing.

5. The process of claim 4 wherein the shearing is additionally provided by dispersing within a confined mixing region.

6. The process of claim 1 wherein the pressures used to introduce the fluid precursor and the dispersates are variable and independently controllable.

7. The process of claim 1 wherein the pressures are controlled so that the volume fraction of dispersates in the composite varies as the composite is cast from the exit region.

8. A process for the continuous manufacture of a composite of a plurality of discrete and substantially uniformly dispersed solid dispersates within a matrix material comprising:

introducing a fluid precursor of the matrix material and a concentrated dispersion into a vessel having entrance and exit regions;

dispersing the concentrated dispersion in the fluid precursor of the matrix material by highly shearing the precursor and the dispersion to provide the composite; and casting the composite through the exit region.

9. A process according to claim 1 wherein vigorous shearing is accomplished by mechanical or electromagnetic agitation.

10. The process of claim 9 wherein the shearing is additionally accomplished by agitation within a confined agitation region.

* * * * *

UNITED STATES PATENT AND TRADEMARK OFFICE

CERTIFICATE OF CORRECTION

PATENT NO. : 4,961,461

DATED : 10/9/90

INVENTOR(S) : Eric Klier, Andreas Mortensen, James A. Cornie, Merton C. Flemings It is certified that error appears in the above-identified patent and that said Letters Patent is hereby corrected as shown below:

Column 4, line 63, the period is missing after "needed".

Claim 7, first line, "claim 1" should be --claim 6--.

Claim 9, first line, "claim 1" should be --claim 8--.

Signed and Sealed this

Ninth Day of June, 1992

*Attest:*

*Attesting Officer*

DOUGLAS B. COMER

*Acting Commissioner of Patents and Trademarks*